US010588203B2

(12) United States Patent
Kishimoto et al.

(10) Patent No.: US 10,588,203 B2
(45) Date of Patent: Mar. 10, 2020

(54) LIGHT SOURCE DRIVING DEVICE, LIGHTING APPARATUS, AND LIGHTING CONTROL SYSTEM

(71) Applicant: Panasonic Intellectual Property Management Co., Ltd., Osaka (JP)

(72) Inventors: Akihiro Kishimoto, Osaka (JP); Shojiro Kido, Osaka (JP); Yukinori Uchida, Osaka (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 0 days.

(21) Appl. No.: 15/984,382

(22) Filed: May 20, 2018

(65) Prior Publication Data

US 2018/0359839 A1 Dec. 13, 2018

(30) Foreign Application Priority Data

Jun. 13, 2017 (JP) ..... 2017-115982

(51) Int. Cl.
*H05B 37/02* (2006.01)
*H05B 33/08* (2020.01)

(52) U.S. Cl.
CPC ..... *H05B 37/0272* (2013.01); *H05B 33/0815* (2013.01); *H05B 37/0254* (2013.01)

(58) Field of Classification Search
CPC ..... H05B 37/0272; H05B 37/0281; H05B 33/0815; H04B 10/116; H04B 10/272
See application file for complete search history.

(56) References Cited

U.S. PATENT DOCUMENTS 5,508,878 A * 4/1996 Pecore ..... G04G 15/00 307/140
2014/0321860 A1 10/2014 Kido
2015/0263807 A1* 9/2015 Yamasaki ..... H05B 33/0854 398/118
2016/0073483 A1* 3/2016 Setomoto ..... H05B 37/0272 315/313
2016/0255698 A1* 9/2016 Harbers ..... H05B 33/0854 315/151
2017/0127495 A1* 5/2017 Mohan ..... H05B 37/0227
2017/0265274 A1* 9/2017 Hirth ..... G01J 1/44

FOREIGN PATENT DOCUMENTS

JP 2007-267037 10/2007
JP 2008-136138 6/2008
JP 2011-091782 5/2011
JP 2013-110599 6/2013
JP 2014-078803 5/2014
WO WO-2006077968 A1 * 7/2006 ..... H04B 10/516

* cited by examiner

*Primary Examiner* — Raymond R Chai
(74) *Attorney, Agent, or Firm* — Renner, Otto, Boisselle & Sklar, LLP

(57) ABSTRACT

A light source driving device includes: a light emission control unit configured to control light emission of a light source in response to an instruction signal; a communication circuit which receives a first instruction signal instructing first light emission control for visible light communication; and a timer which starts to measure waiting time for executing the first light emission control, triggered by the reception of the first instruction signal. The light control unit starts the first light emission control of the light source in response to an instruction signal at the end timing of the waiting time.

14 Claims, 7 Drawing Sheets

| PREAMBLE | ADDRESS | DATA |
|---|---|---|

LIGHT SOURCE DRIVING DEVICE, LIGHTING APPARATUS, AND LIGHTING CONTROL SYSTEM

CROSS REFERENCE TO RELATED APPLICATION

This application claims the benefit of priority of Japanese Patent Application Number 2017-115982 filed on Jun. 13, 2017, the entire content of which is hereby incorporated by reference.

BACKGROUND

1. Technical Field

The present disclosure relates to a light source driving device capable of performing light emission control for visible light communication, a lighting apparatus, and a lighting control system.

2. Description of the Related Art

Luminaires for visible light communication which output data signals by modulating intensity of illumination light have been conventionally known. Japanese Unexamined Patent Application Publication No. 2013-110599 discloses a luminaire for visible light communication capable of easily securing insulation properties in parts through which a modulation signal is transmitted.

SUMMARY

In some conceivable cases, a plurality of lighting apparatuses perform visible light communication operations at the same time. For example, in a conceivable case, a plurality of lighting apparatuses are arranged in a single space, and the plurality of lighting apparatuses respectively blink fast to output the same data signal. In this case, if the plurality of lighting apparatuses blink at different timings, there is a possibility that the data signal cannot be obtained in an area in which light rays emitted by the plurality of lighting apparatuses overlap with each other.

The present disclosure provides a light source driving device, a lighting apparatus, and a lighting control system for reducing a difference in timing for visible light communication operations.

A light source driving device according to an aspect of the present disclosure includes: a light emission control unit configured to control light emission of a light source in response to an instruction signal; a communication circuit which receives a first instruction signal instructing first light emission control for visible light communication; and a timer which starts to measure waiting time for executing the first light emission control, triggered by the reception of the first instruction signal by the communication circuit, wherein the light emission control unit starts the first light emission control of the light source in response to the first instruction signal at the end timing of the waiting time.

The lighting apparatus according to an aspect of the present disclosure includes the light source driving device and the light source.

The lighting control system according to an aspect of the present disclosure includes a plurality of lighting apparatuses.

According to the present disclosure, the light source driving device, the lighting apparatus, and the lighting control system for reducing a difference in timing for visible light communication operations can be implemented.

BRIEF DESCRIPTION OF DRAWINGS

The figures depict one or more implementations in accordance with the present teaching, by way of examples only, not by way of limitations. In the figures, like reference numerals refer to the same or similar elements.

DETAILED DESCRIPTION OF THE EMBODIMENTS

Hereinafter, embodiments are described with reference to the drawings. Each of the exemplary embodiments described below indicates a general or specific example. The numerical values, shapes, materials, constituent elements, the arrangement and connection of the constituent elements, steps, the processing order of the steps etc. indicated in the following exemplary embodiments are mere examples, and therefore do not limit the scope of the present disclosure. Therefore, among the constituent elements in the following exemplary embodiments, constituent elements not recited in any one of the independent claims that define the most generic concept are described as arbitrary constituent elements.

It is to be noted that each of the drawings is a schematic diagram, and is not always illustrated precisely. In addition, in each of the drawings, substantially the same elements are assigned the same reference signs, and overlapping descriptions may be omitted or simplified.

Embodiment 1

[Configurations of a Lighting Control System and a Lighting Apparatus]

Figure 1:
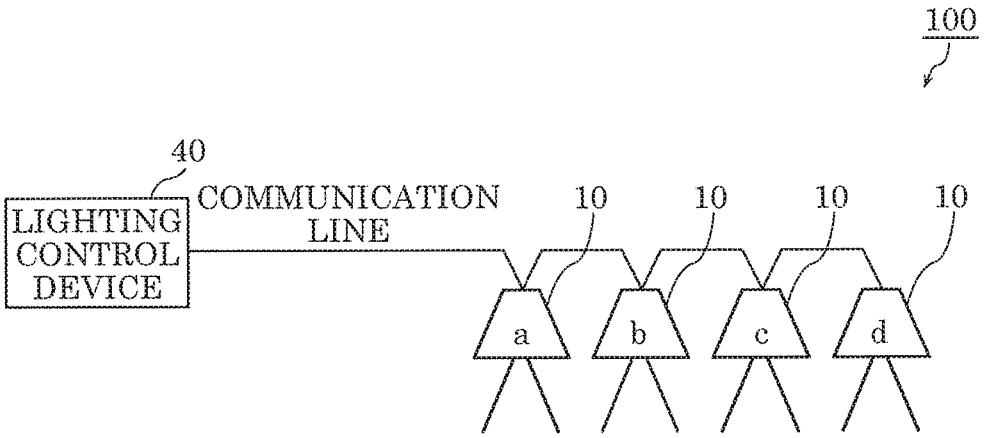
FIG. 1 is a diagram illustrating a configuration of a lighting control system according to Embodiment 1.

Hereinafter, the configurations of the lighting control system and the lighting apparatus according to Embodiment 1 are described with reference to the drawings. First, a lighting control system according to Embodiment 1 is described. FIG. 1 is a diagram illustrating configuration of the lighting control system according to Embodiment 1.

As illustrated in FIG. 1, lighting control system 100 according to Embodiment 1 includes a plurality of lighting apparatuses 10 and lighting control device 40. The total number of the plurality of lighting apparatuses 10 is four in FIG. 1, but the total number of lighting apparatuses 10 is not particularly limited. The plurality of lighting apparatuses 10 may be individually referred to as lighting apparatus a, lighting apparatus b, lighting apparatus c, and lighting apparatus d.

Lighting control device 40 is a controller for controlling the plurality of lighting apparatuses 10, and is disposed outside lighting apparatuses 10. Lighting control device 40 is electrically connected to the plurality of lighting apparatuses 10 via a single signal line. Lighting control device 40 receives a user operation via a user interface, and transmits an instruction signal to each of the plurality of lighting apparatuses 10 via the signal line, based on the user operation received. In other words, the light emission control of the plurality of lighting apparatuses 10 is performed based on the instruction signal transmitted from lighting control device 40.

Figure 2:
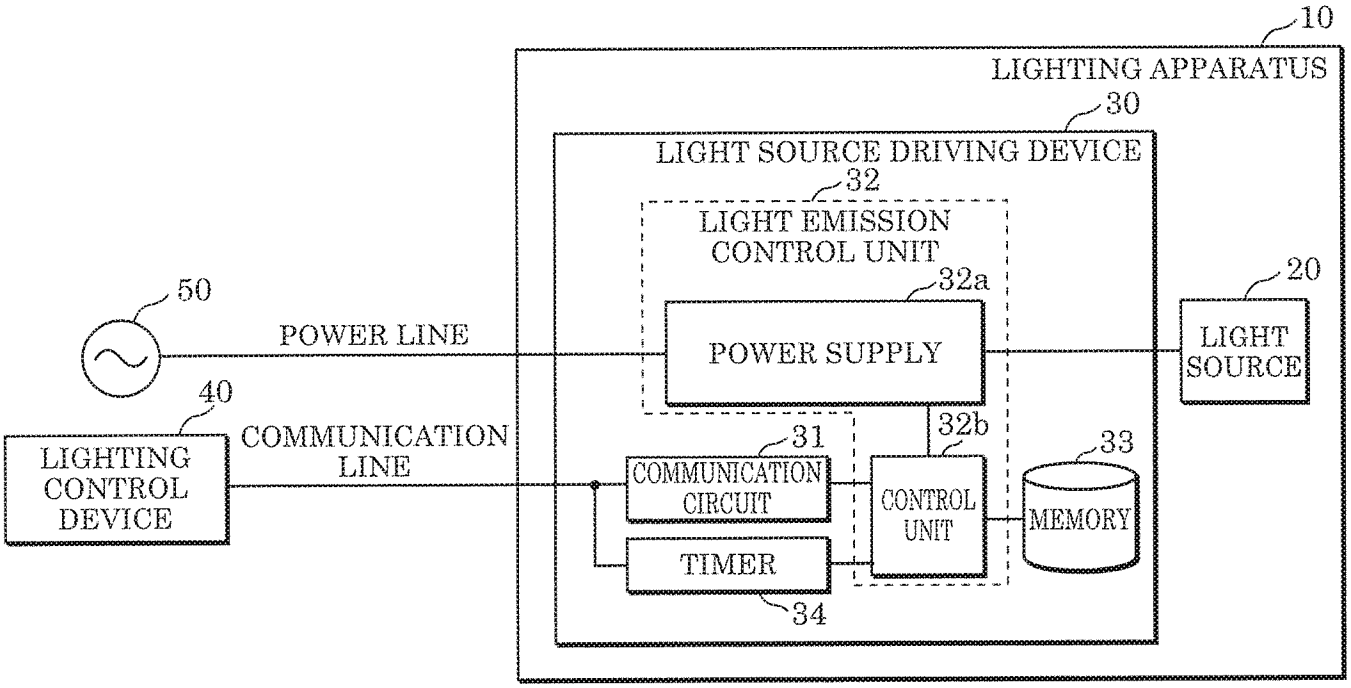
FIG. 2 is a block diagram illustrating a functional configuration of the lighting apparatus according to Embodiment 1.

Next, a configuration of each lighting apparatus 10 is described. FIG. 2 is a block diagram illustrating a functional configuration of lighting apparatus 10. FIG. 2 also illustrates lighting control device 40 and electric power system 50.

As illustrated in FIG. 2, lighting apparatus 10 includes light source 20 and light source driving device 30. Lighting apparatus 10 is a lighting apparatus for indoor lighting, and emits white light. Lighting apparatus 10 is, for example, a ceiling light, and may alternatively be a spotlight or a downlight. As described later, each of the plurality of lighting apparatuses 10 corresponds to a visible light communication operation. Lighting apparatus 10 which is performing a visible light communication operation blinks at a speed at which human eyes cannot recognize the blinking. An information terminal such as a smartphone with an imaging device is capable of using the blinking of lighting apparatus 10 as a data signal. In this way, lighting apparatus 10 has a function for illuminating a space and outputting the data signal. That the lighting apparatus blinks means that a state in which lighting apparatus 10 (light source 20) emits bright light and a state in which lighting apparatus 10 (light source 20) emits dark light or turns off are repeated. Blinking (that is, repeatedly becoming brighter and darker quickly) includes repeatedly turning on and off quickly.

Light source 20 is a light source in which an LED chip or an LED element is used as a light emitting element. Light source 20 emits, for example, white light. Light source 20 is, for example, a light emitting module of a chip on board (COB) type in which an LED chip is directly disposed on a board, and may be alternatively a light emitting module of a surface mount device (SMD) type in which an LED chip is disposed on a board.

Light source driving device 30 is a device for driving light source 20. Light source driving device 30 specifically includes communication circuit 31, light emission control unit 32, memory 33, and timer 34.

Communication circuit 31 is connected to lighting control device 40 disposed outside lighting apparatus 10 via a communication line, and receives an instruction signal from lighting control device 40. Communication circuit 31 is specifically a communication module (communication circuit) including a shift register. It is to be noted that communication circuit 31 may receive an instruction signal from a lighting control device by wireless communication.

Light emission control unit 32 performs light emission control of light source 20. Light emission control unit 32 specifically includes power supply 32*a* and control unit 32*b*.

Power supply 32*a* is a circuit which is connected to a power line through which alternating-current power is supplied from electric power system 50, converts the alternating-current power to direct-current power suitable for light emission of light source 20. Power supply 32*a* includes, for example, a constant current circuit for supplying constant current to light source 20, a modulator circuit for modulating current supplied from the constant current circuit. The constant current circuit includes a filter circuit, a rectifier circuit, a smoothing capacitor, a booster converter, a flyback converter circuit, etc. The modulator circuit includes a switching element for modulating current which is supplied to light source 20.

Control unit 32*b* performs light emission control of light source 20 by controlling power which is supplied from power supply 32*a* to light source 20. Control unit 32*b* is specifically a microcomputer for controlling a switching element included in the modulator circuit. The configuration of control unit 32*b* is not particularly limited.

Light emission control of light source 20 performed by light emission control unit 32 (control unit 32*b*) includes turn-on control, turn-off control, dimming control, and light emission control for visible light communication, etc. In the light emission control for visible light communication, light control unit 32 causes light source 20 to blink at a speed (for example, several kilo hertz to several mega hertz) at which human eyes cannot recognize the blinking. An information terminal such as a smartphone with an imaging device is capable of recognizing the blinking of light source 20 as a data signal using the imaging device.

Memory 33 is a memory device in which a control program etc. which is executed by control unit 32*b* is stored. Memory 33 also stores a modulation signal for visible light communication which is used in light emission control for visible light communication. Memory 33 is specifically implemented as a semiconductor memory or the like.

Timer 34 starts to measure waiting time triggered by a received instruction signal when the instruction signal instructing light emission control for visible light communication is transmitted from the lighting control device 40 and is received by communication circuit 31. Timer 34 is specifically configured as a monostable multivibrator circuit or the like, and may alternatively be any other timer circuit.

[Operations Performed by Lighting Apparatuses]

In lighting control system 100, each of the plurality of lighting apparatuses 10 may blink to output a data signal for visible light communication. In such a case, when the plurality of lighting apparatuses 10 blink at different timings, an information terminal or the like may not be able to recognize the data signal.

Here, one of the causes that make the blinking timings different is differences in time from when respective lighting apparatuses 10 receive an instruction signal instructing light emission control to when respective lighting apparatuses 10 start blinking. For example, the time from when respective lighting apparatuses 10 receive the instruction signal instructing light emission control to when respective lighting apparatuses 10 start blinking includes time required for signal processing such as reception processing, and the time required for such signal processing may differ between lighting apparatuses 10.

In contrast, in lighting control system 100, the plurality of lighting apparatuses 10 start blinking for visible light communication at the same time at the end timing of the waiting time measured by timer 34. For this reason, it is possible to reduce a difference between the timing at which one of lighting apparatuses 10 starts blinking and the timing at which another of lighting apparatuses 10 starts blinking.

Figure 3:
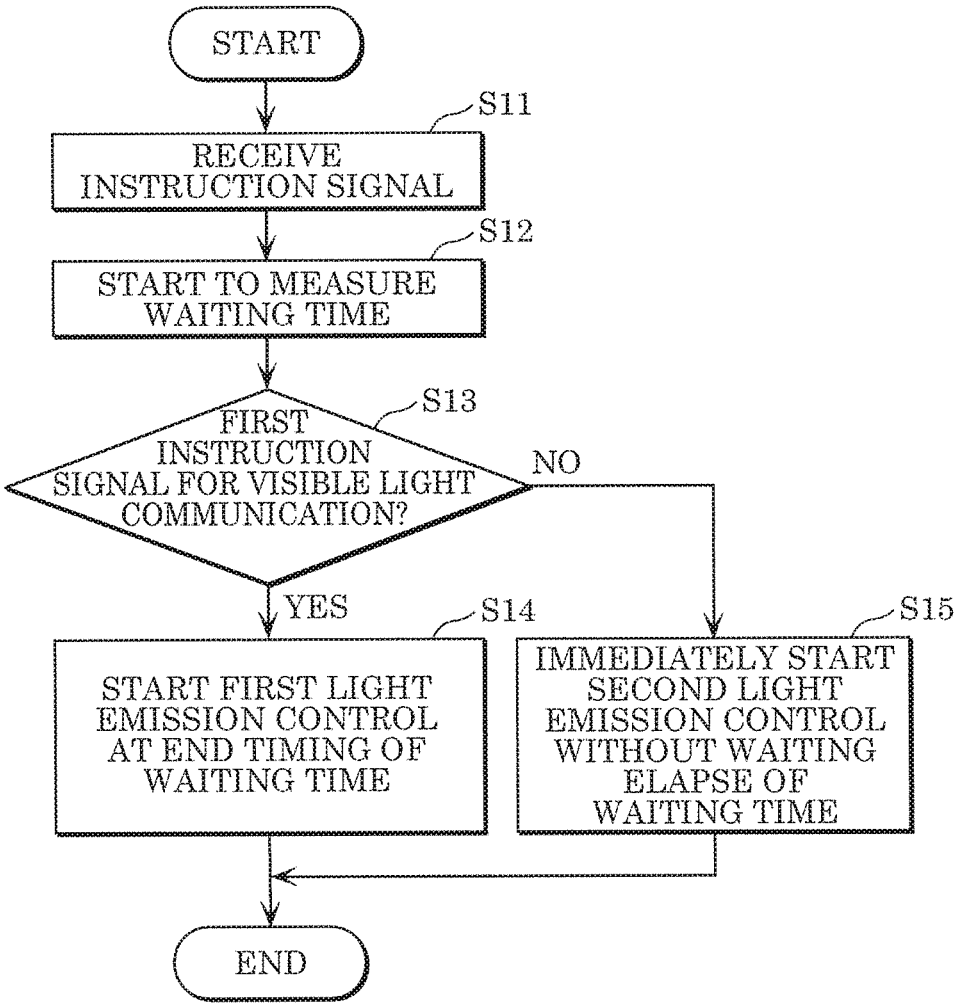
FIG. 3 is a flowchart of operations performed by the lighting apparatus according to Embodiment 1.
Figures 4, 5:
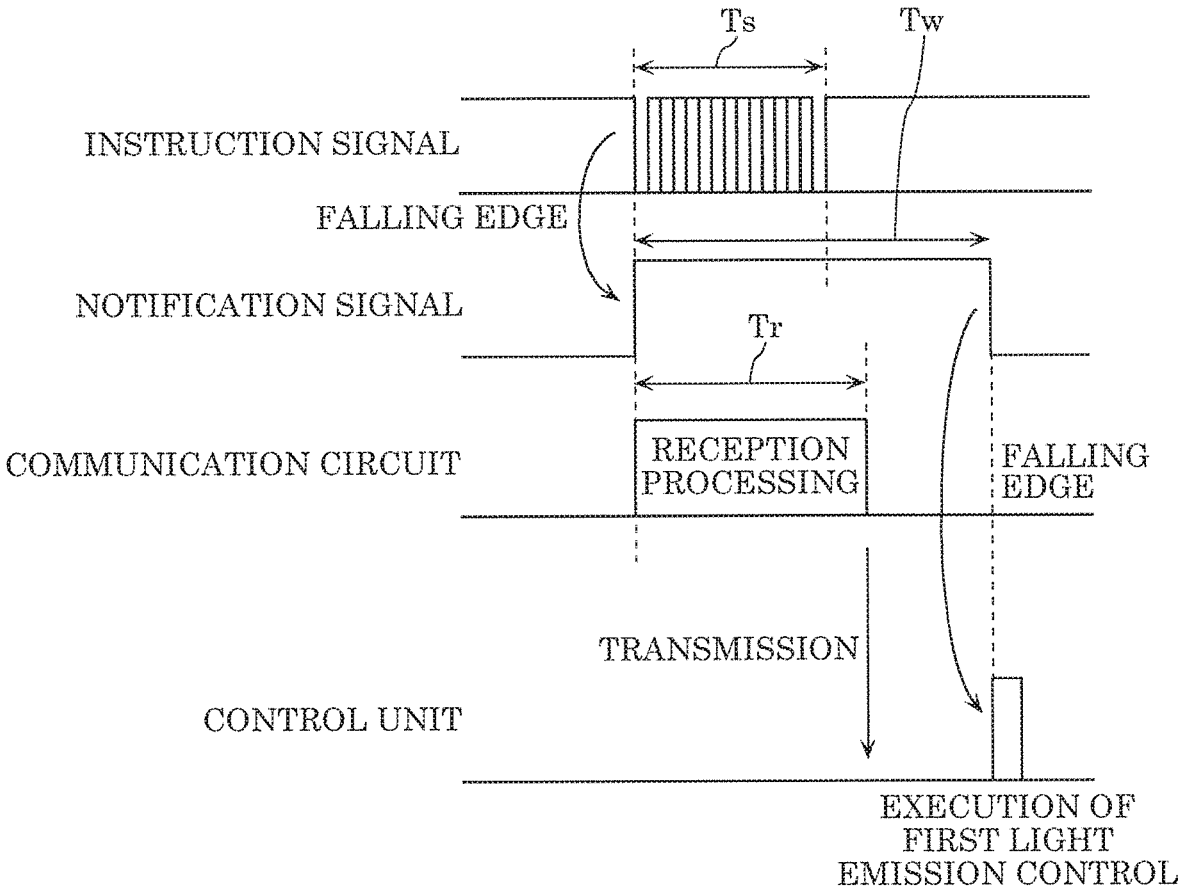
FIG. 4 is a timing chart of light emission control for visible light communication.
FIG. 5 is a diagram illustrating an example of a signal format of an instruction signal.

Hereinafter, operations performed by such lighting apparatuses 10 are described mainly with reference to FIGS. 3 and 4. FIG. 3 is a flowchart of operations performed by lighting apparatuses 10. FIG. 4 is a timing chart of light emission control for visible light communication.

First, communication circuit 31 receives an instruction signal instructing light emission control from lighting control device 40 via a communication line (S11). As described above, communication circuit 31 includes a shift register, and stores the signal transmitted through the communication line to the resister according to a signal format illustrated in FIG. 5. FIG. 5 is a diagram illustrating an example of a signal format of an instruction signal.

As illustrated in FIG. 5, the instruction signal includes a preamble area, an address area, and a data area. The data area indicates what light emission control the instruction signal instructs.

It is to be noted that, hereinafter, light emission control for visible light communication is described as first light emission control, and an instruction signal instructing first light emission control is described as a first instruction signal. Light emission control for control other than visible light communication such as turn-on control, turn-off control, or dimming control is described as second light emission control, and an instruction signal instructing second light emission control is described as a second instruction signal.

Next, timer 34 starts to measure waiting time Tw triggered by the reception of the instruction signal by communication circuit 31 (S12). As illustrated in FIG. 4, when the signal line reaches a high level in an idle state in which no signal is input to the signal line, the monostable multivibrator circuit included in timer 34 keeps outputting a notification signal of a high level to control unit 32*b* until waiting time Tw ends, triggered by a falling edge generated when the instruction signal is input to the signal line. The level of the notification signal changes to a low level after the waiting time ends.

Waiting time Tw is set to time longer than or equal to time required for all of lighting apparatuses 10 to be placed into a stand-by state for starting first light emission control. Waiting time Tw is, for example, longer than signal length (time duration) Ts of the instruction signal. In addition, waiting time Tw is longer than time Tr required for the reception processing of the instruction signal performed by communication circuit 31. It is to be noted that time Tr is longer than signal length Ts.

Upon completing the reception of the instruction signal, communication circuit 31 transmits the received instruction signal to control unit 32*b*. Control unit 32*b* refers to the data area of the transmitted instruction signal, and determines whether or not the instruction signal received by communication circuit 31 is a first instruction signal instructing the first light emission control for visible light signal (S13).

When determining that the received instruction signal is a first instruction signal instructing the first light emission control for visible light communication (Yes in S13), control unit 32*b* (light emission control unit 32) starts the first light emission control of light source 20 at an end timing of waiting time Tw measured by timer 34 (S14). More specifically, upon detecting a falling edge of the notification signal, control unit 32*b* starts output of a modulation signal for visible light communication read out from memory 33 so as to control a switching element included in the modulator circuit of power supply 32*a*. As a result, blinking of light source 20 for visible light communication is started at an end timing of waiting time Tw. It is to be noted that, when control unit 32*b* is performing other signal processing, the signal processing relating to the first light emission control may be preferentially handled as interrupt processing.

Figure 6:
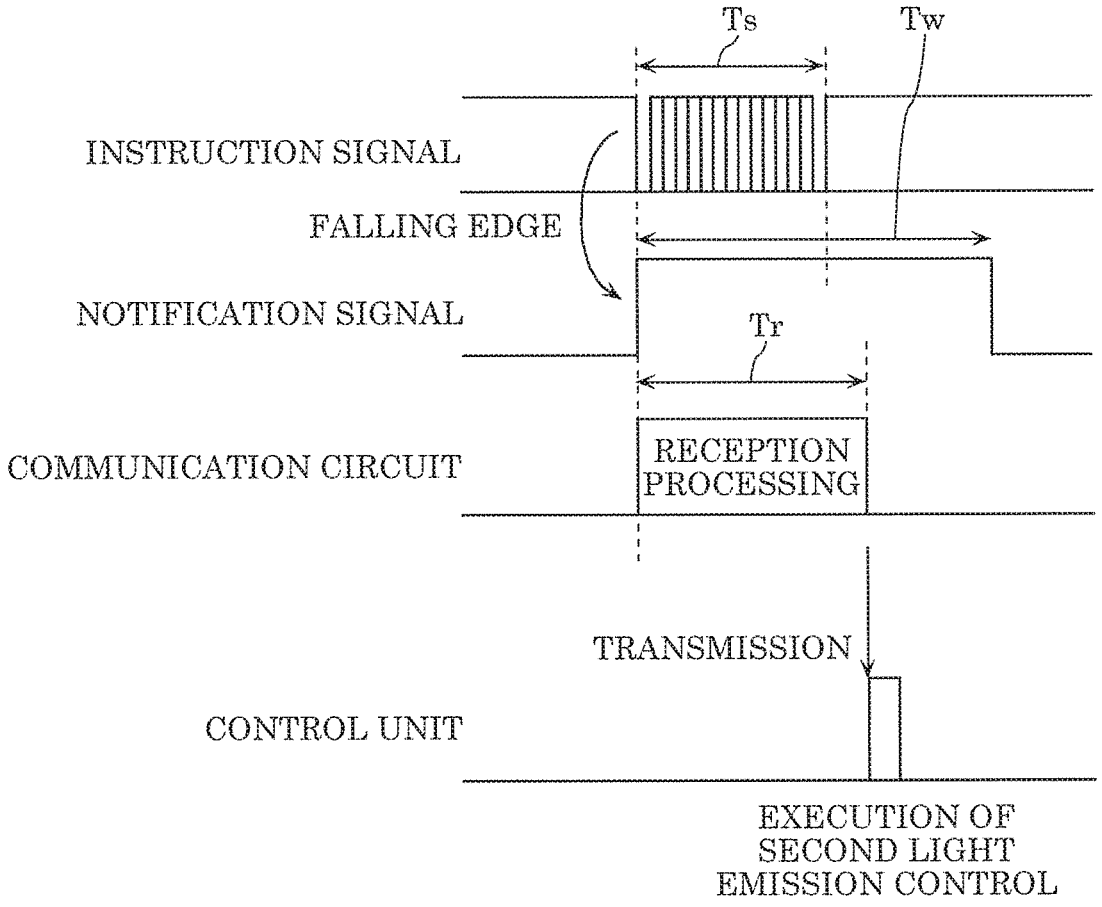
FIG. 6 is a timing chart of light emission control for control other than visible light communication.

When determining that the received instruction signal is a second instruction signal instructing the second light emission control for control other than visible light signal (No in S13), control unit 32*b* (light emission control unit 32) does not need to match the timing for starting the second light emission control of one of lighting apparatuses 10 and the timing for starting the second light emission control of another of lighting apparatuses 10. For this reason, control unit 32*b* immediately starts the second light emission control without waiting elapse of waiting time Tw measured by timer 34 (S15). In other words, control unit 32*b* ignores the logic of the notification signal and starts the second light emission control irrespective of the logic. FIG. 6 is a timing chart of such second light emission control (light emission control for control other than visible light communication).

As described above, lighting control system 100 is capable of reducing a difference in timing for starting light emission control for visible light communication. In other words, lighting control system 100 is capable of synchronizing data signals for visible light communication output by respective lighting apparatuses 10 with each other.

In addition, lighting system 100 does not require any exclusive control line for visible light communication. In lighting system 100, both of the first light emission control for visible light communication and the second light emission control such as dimming control are performed only using the communication line.

[Variation]

The method for measuring waiting time by timer 34 described in Embodiment 1 is a mere example. For example, timer 34 may extend waiting time Tw (a period in which an instruction signal reaches a high level) by predetermined time each time a falling edge of an instruction signal is detected. In this case, waiting time Tw does not have a fixed length and corresponds to signal length Ts, and thus such extension is useful when signal length Ts is not a fixed length but a variable length.

In addition, although the modulation signal for visible light communication has been stored in memory 33 in advance in Embodiment 1, a modulation signal for visible light communication may be transmitted by lighting control device 40. For example, the modulation signal for visible light communication may be included in the data area of an instruction signal. In this case, lighting apparatus 10 receives the modulation signal for visible light communication via the communication line.

Embodiment 2

[Reduction in Difference in Timing for Receiving Instruction Signal]

As another one of the causes that make the blinking timings for visible light communication different, it is conceivable that a difference in the lengths of a signal line to respective lighting apparatuses makes a difference in the timing at which respective lighting apparatuses receive the first instruction signal. In the example of FIG. 1, the length of the communication line from lighting apparatus a to lighting control device 40 is less than the length of the communication line from lighting apparatus d to lighting control device 40. Accordingly, lighting apparatus a receives the first instruction signal at a timing earlier than the timing for lighting apparatus d. In other words, the timing at which lighting apparatus a receives the first instruction signal and the timing at which lighting apparatus d receives the first instruction signal differ from each other. Such a difference in the reception timing becomes remarkable when the signal line is comparatively longer.

In view of this, for example, when the plurality of lighting apparatuses 10 are installed, waiting time Tw is adjusted for each lighting apparatus 10 considering the difference in timing for receiving the first instruction signal. For example, as illustrated in FIG. 1, when the lengths of the signal line from lighting control device to respective lighting control devices 40 are lighting apparatus a<lighting apparatus b<lighting apparatus c<lighting apparatus d, waiting times Tw may be waiting time Ta for lighting apparatus a<waiting time Tb for lighting apparatus b<waiting time Tc for lighting apparatus c<waiting time Td for lighting apparatus d. The waiting time for lighting apparatus a is longer than the waiting time for lighting apparatus d. Lighting apparatus a and lighting apparatus d are included in the plurality of lighting apparatuses 10 and connected to lighting control device 40 via the communication line, and a first length of the communication line from lighting apparatus a to lighting control device 40 is less than a second length of the communication line from lighting apparatus d to lighting control device 40. Setting the waiting times respectively reduces a difference in timing for starting the first light emission control due to difference in the reception timing of the first instruction signal.

[Configuration for Adjusting Waiting Time]

Figure 7:
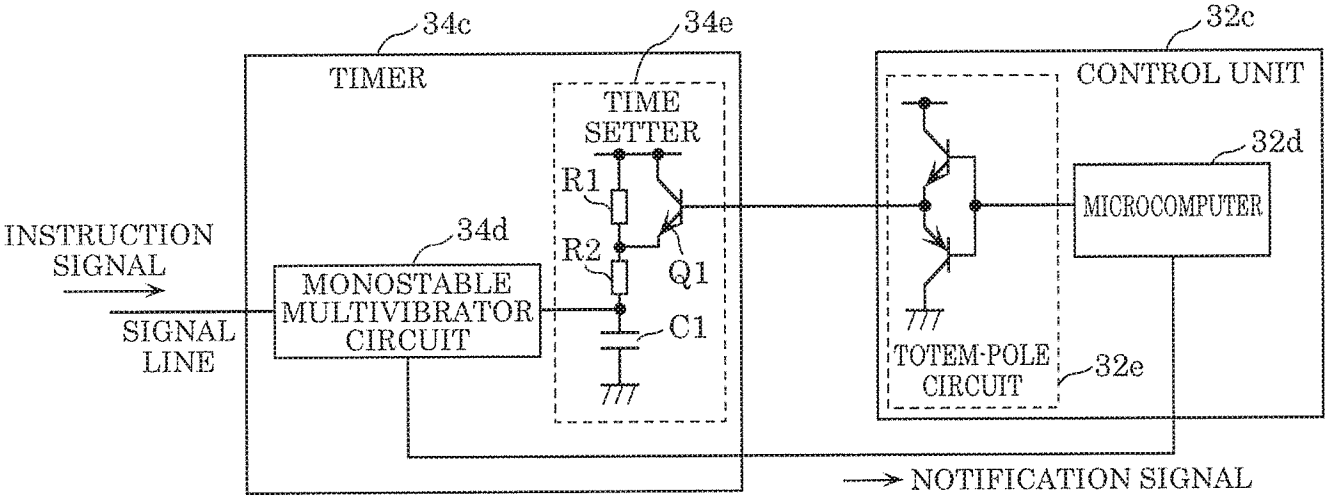
FIG. 7 is a diagram illustrating an example of a configuration for adjusting waiting time.

Light source driving device 30 may have a configuration for adjusting waiting time Tw so that a user can easily adjust waiting time Tw. FIG. 7 is a diagram illustrating an example of the configuration for adjusting waiting time Tw. FIG. 7 illustrates: control unit 32*c* corresponding to control unit 32*b* of light source driving device 30; and timer 34*c* corresponding to timer 34 of light source driving device 30.

Control unit 32*c* includes microcomputer 32*d* and totem-pole circuit 32*e*. Totem-pole circuit 32*e* is a circuit to which two transistors are connected in series. Totem-pole circuit 32*e* outputs a high-level signal or a low-level signal to an output terminal of totem-pole circuit 32*e* according to an output signal from microcomputer 32*d*.

Timer 34*c* includes monostable multivibrator circuit 34*d* and time setter 34*e*. Time setter 34*e* is a time setter circuit for setting waiting time Tw of monostable multivibrator 34*d*.

Time setter 34*e* specifically includes: resistor R1, resistor R2, and capacitor C1 connected in series; and transistor Q1 connected in parallel to resistor R1. Time setter 34*e* is a circuit which determines a time constant corresponding to waiting time Tw. The base terminal of transistor Q1 is electrically connected to an output terminal of totem-pole circuit 32*e*.

When the output signal from microcomputer 32*d* is at a high level, transistor Q1 of time setter 34*e* turns off. Accordingly, capacitor C1 is charged via resistors R1 and R2 connected in series.

When a falling edge of an instruction signal is input to monostable multivibrator circuit 34*d* via the signal line, monostable multivibrator circuit 34*d* makes a notification signal to be at high level and discharges capacitor C1 for a while at the same time. After the discharge of capacitor C1, capacitor C1 is charged via resistors R1 and R2. When the voltage of capacitor C1 reaches a predetermined value by the charge, monostable multivibrator circuit 34*d* makes the notification signal to be at a low level.

When the output signal from microcomputer 32*d* is at a low level, transistor Q1 of time setter 34*e* turns on. Accordingly, capacitor C1 is charged only via resistor R2 out of resistors R1 and R2.

When a falling edge of the instruction signal is input to monostable multivibrator circuit 34*d* via the signal line, monostable multivibrator circuit 34*d* makes the notification signal to be at a high level and discharges capacitor C1 for a while at the same time. After the discharge of capacitor C1, capacitor C1 is charged only via resistor R2, and when the voltage of capacitor C1 reaches a predetermined value by the charge, monostable multivibrator circuit 34*d* makes the notification signal to be at a low level. In this case, capacitor C1 is charged in shorter time than when capacitor C1 is charged via resistors R1 and R2.

Accordingly, when the output signal of microcomputer 32*d* is at the low level, a period in which the notification signal is at the high level can be reduced than when the output signal of microcomputer 32*d* is at the high level. In other words, when the output signal of microcomputer 32*d* is at the low level, waiting time Tw is reduced than when the output signal of microcomputer 32*d* is at the high level.

In this way, when light source driving device 30 includes the configuration illustrated in FIG. 7, waiting time Tw is adjusted by changing the logic of the output signal from microcomputer 32*d*. In other words, the user can easily adjust waiting time Tw by rewriting a program for causing microcomputer 32*d* to operate so as to change the logic of the output signal.

[Another Configuration for Adjusting Waiting Time]

Figure 8:
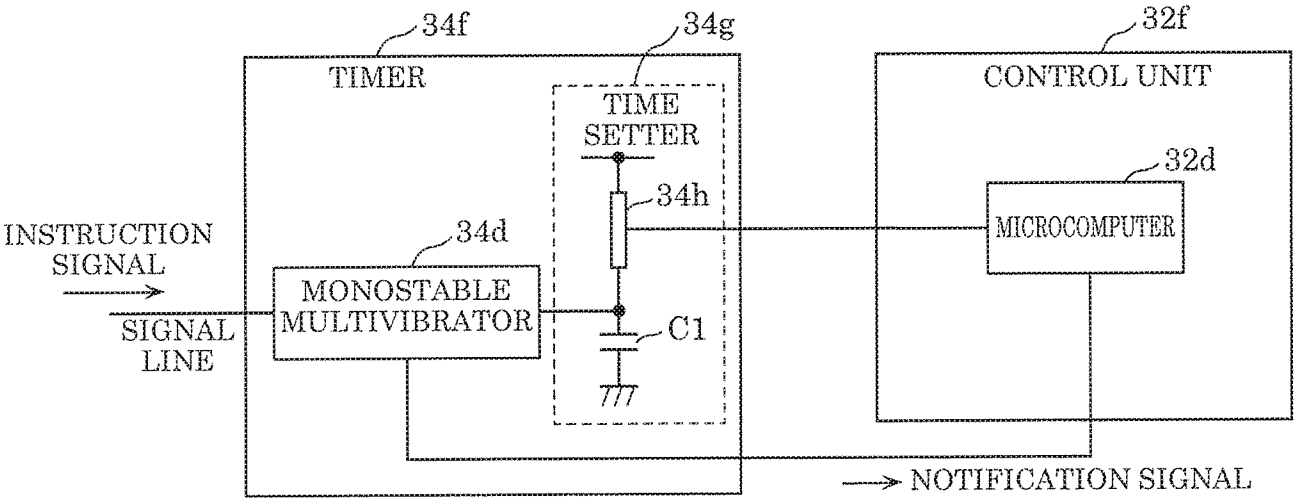
FIG. 8 is a diagram illustrating an example of another configuration for adjusting waiting time.

It is to be noted that light source driving device 30 may include a configuration as illustrated in FIG. 8 so as to adjust waiting time Tw. FIG. 8 is a diagram illustrating an example of another configuration for adjusting waiting time Tw. FIG. 8 illustrates: control unit 32*f* corresponding to control unit 32*b* of light source driving device 30; and timer 34*f* corresponding to timer 34 of light source driving device 30.

Control unit 32*f* includes microcomputer 32*d*. Timer 34*f* includes monostable multivibrator circuit 34*d* and time setter 34*g*.

Time setter 34*g* is a time setter circuit for setting waiting time Tw of monostable multivibrator 34*d*. Time setter 34*g* specifically includes digital potentiometer 34*h* and capacitor C1. Digital potentiometer 34*h* and capacitor C1 are connected in series.

Time setter 34*g* is a circuit which determines a time constant corresponding to waiting time Tw. Time required to charge capacitor C1 is adjusted according to a resistance value of digital potentiometer 34*h*. In other words, waiting time Tw is adjusted according to the resistance value of digital potentiometer 34*h*.

Digital potentiometer 34*h* obtains a command signal which is output from microcomputer 32*d*, and the resistance value changes according to the obtained command signal. Accordingly, light source driving device 30 having the configuration in FIG. 8 adjusts waiting time Tw by changing the command signal which is output from microcomputer 32*d*. In other words, the user can easily adjust waiting time Tw by rewriting a program for causing microcomputer 32*d* to operate so as to change the command signal.

(Summary)

As described above, light source driving device 30 includes: light emission control unit 32 configured to control light emission of light source 20 in response to an instruction signal; communication circuit 31 which receives a first instruction signal instructing first light emission control for visible light communication; and timer 34 which starts to measure waiting time Tw for executing the first light emission control, triggered by the reception of the first instruction signal. Light control unit 32 starts the first light emission control of light source 20 in response to the first instruction signal at the end timing of waiting time Tw.

In this way, light source driving device 30 is capable of reducing a difference in timing for starting the first light emission control which is made between light source driving device 30 and another light source driving device which has a configuration similar to that of light source driving device 30 and operates after receiving the same first instruction signal. In other words, light source driving device 30 is capable of reducing a difference in timing for a visible light communication operation.

In addition, waiting time Tw is, for example, longer than the signal length of the first instruction signal.

In this way, light source driving device 30 is capable of reducing a difference in timing for starting the first light emission control which is made between light source driving device 30 and the other light source driving device which has a configuration similar to that of source driving device 30 and operates after receiving the same first instruction signal.

In addition, as with timer 34*c* (or timer 34*f*), timer 34 may include time setter 34*e* (or timer 34*f*) for setting waiting time Tw.

In this way, the user can adjust waiting time Tw. For example, waiting time Tw for a lighting apparatus for which the length of the signal line to the lighting apparatus is longer is set to be shorter, which reduces a difference in timing for starting the first light emission control based on the difference in the reception timing of the first instruction signal.

In addition, communication circuit 31 may receive a second instruction signal instructing second light emission control for control other than visible light communication, and when the second instruction signal is received by the communication unit, light emission control unit 32 may start the second light emission control of light source 20 before elapse of waiting time Tw.

In this way, it is possible to reduce occurrence of a time lag between reception time of the second instruction signal and start time of the second light emission control.

Lighting apparatus 10 includes light source driving device 30 and light source 20.

In this way, lighting apparatus 10 is capable of reducing a difference in timing for starting the first light emission control which is made between lighting apparatus 10 and another lighting apparatus which has a configuration similar to that of lighting apparatus 10 and operates after receiving the same first instruction signal.

Lighting control system 100 includes a plurality of lighting apparatuses 10.

In this way, lighting control system 100 is capable of reducing a difference in timing for starting the first light emission control which is made between the plurality of lighting apparatuses 10.

Lighting control system 100 may further include lighting control device 40 which transmits a first instruction signal to each of the plurality of lighting apparatuses 10 via a communication line. Waiting time Ta for lighting apparatus a may be longer than waiting time Td for lighting apparatus d. Lighting apparatus a and lighting apparatus d are included in the plurality of lighting apparatuses 10 and connected to lighting control device 40 via the communication line, and a first length of the communication line from lighting apparatus a to lighting control device 40 may be less than a second length of the communication line from lighting apparatus d to lighting control device 40.

Lighting apparatus a is an example of a first lighting apparatus and lighting apparatus d is an example of a second lighting apparatus.

Setting the waiting times respectively in this way reduces a difference in timing for starting the first light emission control due to difference in the reception timing of the first instruction signal.

Other Embodiments

The present disclosure is not limited to the above-described embodiments.

For example, the circuit configuration described in each of the above embodiments is a mere example, and thus the present disclosure is not limited to the above-described circuit configuration. The present disclosure covers any circuit which provides the unique functions of the present disclosure, in addition to the above-described circuit configuration. For example, the present invention covers any circuit in which elements such as a switching element (transistor), a resistor element, and a capacitor element are connected in series or in parallel to a certain element, within a range in which functions similar to those of the circuit configuration can be provided.

In addition, in any of the above-described embodiments, any constituent element such as a timer configured as hardware (circuit) may be implemented by executing software. For example, a constituent element implemented as hardware may be implemented by a program executing unit such as a CPU or a processor reading out and executing a software program recorded on a recording medium that is for example a hard disc or a semiconductor memory.

In addition, these general and specific aspects of the present disclosure may be implemented using a system, an apparatus, a method, an integrated circuit, a computer program, or a recording medium such as a computer-readable CD-ROM. In addition, these general and specific aspects of the present disclosure may be implemented using any combination of a system, an apparatus, a method, an integrated circuit, a computer program, and a recording medium.

For example, the present disclosure may be implemented as a signboard including a light source, a light source driving device, and a display board which is illuminated by the light source and includes at least one of characters and graphic symbols. In addition, the present disclosure may be implemented as a light source driving method, or a program for causing a computer to execute the light source driving method. In addition, the present disclosure may be implemented as a lighting control method, or a program for causing a computer to execute the lighting control method.

In addition, the present disclosure may cover embodiments that a person skilled in the art may arrive at by adding various kinds of modifications to any of the above embodiments or by arbitrarily combining some of the constituent elements in different embodiments within the scope of the present disclosure.

It is intended by the following claims to claim any and all modifications and variations that fall within the true scope of the present teachings.

What is claimed is:

1. A light source driving device, comprising:

a light emission control unit configured to control light emission of a light source in response to an instruction signal;

a communication circuit which receives a first instruction signal instructing first light emission control for visible light communication; and a timer circuit which starts to measure a predetermined waiting time for executing the first light emission control at a start time corresponding to an edge of the first instruction signal received by the communication circuit, wherein the light emission control unit starts the first light emission control of the light source in response to the first instruction signal at an end timing of the predetermined waiting time.

2. The light source driving device according to claim 1, wherein the predetermined waiting time is longer than a signal length of the first instruction signal.

3. The light source driving device according to claim 1, wherein the timer circuit includes a time setter for setting the predetermined waiting time.

4. The light source driving device according to claim 3, wherein the time setter is user adjustable to set the predetermined waiting time.

5. The light source driving device according to claim 3, wherein the time setter is a circuit which determines a time constant corresponding to the waiting predetermined time.

6. The light source driving device according to claim 5, wherein the time setter is a circuit which includes a resistor and a capacitor connected in series to the resistor.

7. The light source driving device according to claim 6, wherein the resistor is a digital potentiometer, and the light emission control unit outputs a signal for changing a resistance value of the digital potentiometer.

8. A lighting apparatus, comprising:

the light source driving device according to claim 1; and the light source.

9. A lighting control system, comprising:

a plurality of the lighting apparatuses according to claim 8.

10. The lighting control system according to claim 9, wherein the predetermined waiting time for each of the plurality of lighting apparatuses is set to time longer than or equal to time required for all of the plurality of lighting apparatuses to be placed into a stand-by state for starting first light emission control in response to the first instruction signal.

11. The lighting control system according to claim 9, further comprising:

a lighting control device which transmits the first instruction signal to each of the plurality of lighting apparatuses via a communication line, wherein the predetermined waiting time for a first lighting apparatus is longer than the predetermined waiting time for a second lighting apparatus, the first lighting apparatus and the second lighting apparatus being included in the plurality of lighting apparatuses and connected to the lighting control device via the communication line, a length of the communication line from the first lighting apparatus to the lighting control device being less than a length of the communication line from the second lighting apparatus to the lighting control device.

12. The lighting control system according to claim 11, wherein the predetermined waiting time for each of the plurality of lighting apparatuses is set to time longer than or equal to time required for all of the plurality of lighting apparatuses to be placed into a stand-by state for starting first light emission control in response to the first instruction signal.

13. The light source driving device according to claim 1, wherein the communication circuit receives the first instruction signal via a signal line, and the timer circuit starts to measure the predetermined waiting time at the start time corresponding to the edge of the first instruction signal received via the signal line.

14. A light source driving device, comprising:

a light emission control unit configured to control light emission of a light source in response to an instruction signal;

a communication circuit which receives a first instruction signal instructing first light emission control for visible light communication; and a timer which starts to measure a predetermined waiting time for executing the first light emission control at a start time corresponding to an edge of the first instruction signal received by the communication circuit, wherein the light emission control unit starts the first light emission control of the light source in response to the first instruction signal at an end timing of the predetermined waiting time, wherein the communication circuit receives a second instruction signal instructing second light emission control for control other than visible light communication, and when the second instruction signal is received by the communication unit, the light emission control unit starts the second light emission control of the light source before elapse of the predetermined waiting time.

* * * * *